United States Patent [19]

Matsumoto et al.

[11] Patent Number: 5,073,211

[45] Date of Patent: Dec. 17, 1991

[54] METHOD FOR MANUFACTURING STEEL ARTICLE HAVING HIGH MAGNETIC PERMEABILITY AND LOW COERCIVE FORCE

[75] Inventors: Kazuaki Matsumoto; Toshimichi Omori; Tetsuya Sanpei; Hisatoshi Tagawa, all of Tokyo, Japan

[73] Assignee: NKK Corporation, Tokyo, Japan

[21] Appl. No.: 494,809

[22] Filed: Mar. 14, 1990

Related U.S. Application Data

[63] Continuation of Ser. No. 356,771, May 24, 1989, abandoned.

[30] Foreign Application Priority Data

Jun. 30, 1988 [JP] Japan ..... 63-163717

[51] Int. Cl.[5] ..... H01F 1/00

[52] U.S. Cl. ..... 148/120; 148/121

[58] Field of Search ..... 148/120, 121

[56] References Cited

U.S. PATENT DOCUMENTS 3,892,604 7/1975 Thornburg et al. ..... 148/120

3,892,605 7/1975 Thornburg ..... 148/120

FOREIGN PATENT DOCUMENTS 60-86210 5/1985 Japan .

1096291 6/1984 U.S.S.R. ..... 148/120

*Primary Examiner*—John P. Sheehan

*Attorney, Agent, or Firm*—Frishauf, Holtz, Goodman & Woodward

[57] ABSTRACT

A method for manufacturing a steel article having a high magnetic permeability and a low coercive force, comprising the steps of: heating a material consisting essentially of:

carbon: from 0.02 to 0.08 wt. %, manganese: from 0.05 to 0.49 wt. %, and the balance being iron and incidental impurities, to a temperature of at lest 1,000° C.; then hot-working the thus heated material at a finishing temperature of at least 1,000° C. to prepare a steel article and then cooling the thus prepared steel article to a temperature of up to 500° C. at a cooling rate of up to 0.5° C./second; thereby causing crystal grains of the steel article to grow to a grain size of at least 50 μm to impart a high magnetic permeability and a low coercive force to the steel article.

4 Claims, 1 Drawing Sheet

METHOD FOR MANUFACTURING STEEL ARTICLE HAVING HIGH MAGNETIC PERMEABILITY AND LOW COERCIVE FORCE

This application is a Continuation of application Ser. No. 07/356,771, filed May 24, 1989 now abandoned.

REFERENCE TO PATENTS, APPLICATIONS AND PUBLICATIONS PERTINENT TO THE INVENTION

As far as we know, there is available the following prior art document pertinent to the present invention: Japanese Patent Provisional Publication No. 60-86,210 dated May 15, 1985.

The contents of the prior art disclosed in the above-mentioned prior art document will be discussed under the heading of the "BACKGROUND OF THE INVENTION."

FIELD OF THE INVENTION

The present invention relates to a method for manufacturing a steel article having excellent magnetic properties including a high magnetic permeability and a low coercive force.

BACKGROUND OF THE INVENTION

In general, a rotor of an electric power generator or the like is manufactured by a method which comprises: refining molten steel in a steel-making furnace such as a converter, casting the molten steel into a bloom, hot-rolling the thus cast bloom into a steel bar, cold-forging the thus hot-rolled steel bar to prepare a rotor, and then, subjecting the thus prepared rotor to an annealing to impart same desired magnetic properties.

The above-mentioned annealing is applied to the rotor for the purpose of imparting desired magnetic properties including a high magnetic permeability and a low coercive force to the rotor. An annealing treatment however requires large-scale facilities and a considerable amount of thermal energy. If the annealing process can be omitted from the manufacturing processes of the rotor, therefore, it would permit simplification of equipment as well as saving of thermal energy.

As a method for manufacturing a steel sheet having excellent magnetic properties including a high magnetic permeability and a low coercive force by heating a slab as a material and hot-rolling the heated slab without applying the above-mentioned annealing, the following method has conventionally been proposed:

A method for manufacturing a hot-rolled high-tensile electrical steel sheet, as disclosed in Japanese Patent Provisional Publication No. 60-86,210 dated May 15, 1985, which comprises the steps of;

heating a slab consisting essentially of;
carbon: from 0.06 to 0.09 wt. %,
manganese: from 0.5 to 1.4 wt. %,
silicon: up to 0.10 wt. %,
aluminum: up to 0.10 wt. %,
titanium: from 0.04 to 0.25 mt.%, and
the balance being iron and incidental impurities,
where, the respective contents of sulfur and nitrogen as said incidental impurities being:
up to 0.02 wt. % for sulfur, and
up to 0.01 wt. % for nitrogen,
to a temperature of at least 1,200° C.; then hot-rolling the thus heated slab into a steel sheet at a finishing temperature of at least Ar3 point and up to 900° C.; and then coiling the thus hot-rolled steel sheet at a temperature of from 650° to 500° C. (hereinafter referred to as the "prior art").

The above-mentioned prior art involves the following problems: In the prior art, manganese is added to the steel sheet in order to improve the strength thereof. However, the manganese content of the steel sheet is as high as from 0.5 to 1.4 wt. %. This results in a deteriorated hot-workability and a low magnetic flux density in the steel sheet, leading to a lower magnetic permeability. In addition, in the prior art, titanium is added in an amount of 0.04 to 0.25 wt. % to the steel sheet in order to improve the strength thereof. As a result, a strain produced during hot-working tends to remain in the steel sheet, leading to a lower magnetic permeability. In the prior art, furthermore, the slab is hot-rolled into the steel sheet at a finishing temperature as low as up to 900° C. in order to prevent the crystal grains of the steel sheet from coarsening. As a result, a strain produced during hot-working tends to remain in the steel sheet, leading to a lower magnetic permeability of the steel sheet.

Under such circumstances, there is a strong demand for the development of a method for manufacturing a steel article having, as compared with the above-mentioned prior art, more excellent magnetic properties including a maximum magnetic permeability $\mu$ max of at least 4,500 and a coercive force Hc of up to 1.2 Oersted (Oe), but such a method has not as yet been proposed.

SUMMARY OF THE INVENTION

An object of the present invention is therefore to provide a method for manufacturing a steel article having excellent magnetic properties including a maximum magnetic permeability $\mu$ max of at least 4,500 and a coercive force Hc of up to 1.2 Oersted (Oe).

In accordance with one of the features of the present invention, there is provided a method for manufacturing a steel article having a high magnetic permeability and a low coercive force, characterized by comprising the steps of:

using a material consisting essentially of:
carbon: from 0.02 to 0.08 wt. %,
manganese: from 0.05 to 0.49 wt. %, and
the balance being iron and incidental impurities, where, the respective contents of silicon, aluminum and nitrogen as said incidental impurities being:
up to 0.10 wt. % for silicon,
up to 0.02 wt. % for aluminum, and
up to 0.004 wt. % for nitrogen;
heating said material to a temperature of at least 1,000° C.; then
hot-working said material thus heated at a finishing temperature of at least 1,000° C. to prepare a steel article; and then
cooling said steel article thus prepared to a temperature of up to 500° C. at a cooling rate of up to 0.5° C./second;
thereby causing crystal grains of said steel article to grow to a grain size of at least 50 $\mu$m to impart a high magnetic permeability and a low coercive force to said steel article.

BRIEF, DESCRIPTION OF THE DRAWING

FIG. 1 is a graph illustrating the relationship between the crystal grain size and the maximum magnetic permeability in a steel article having a chemical composition within the scope of the present invention.

DETAILED DESCRIPTION OF PREFERRED EMBODIMENTS

Figure 1:
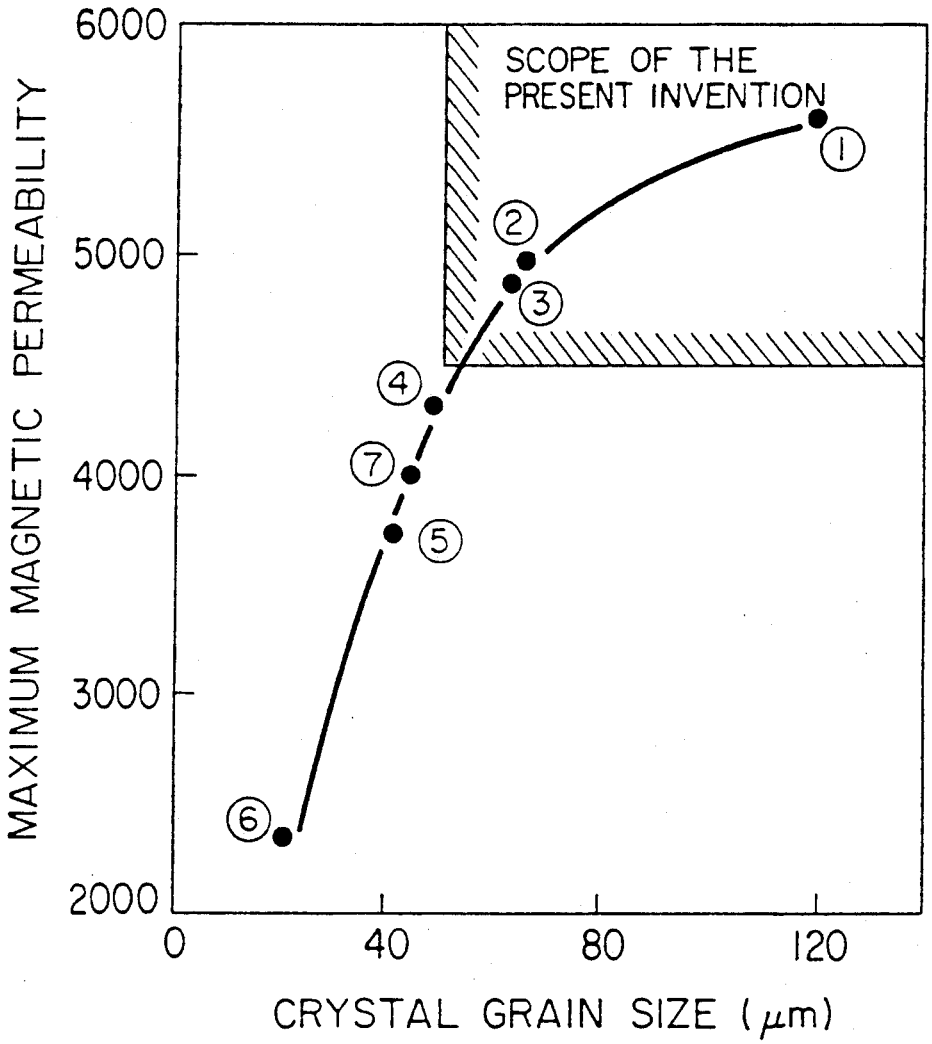

From the above-mentioned point of view, extensive studies were carried out to develop a method for manufacturing a steel article having, as compared with the above-mentioned prior art, more excellent magnetic properties including a higher magnetic permeability and a lower coercive force . As a result, the following findings were obtained: By heating a material consisting essentially of:

carbon: from 0.02 to 0.08 wt. %, manganese: from 0.05 to 0.49 wt. %, and the balance being iron and incidental impurities, to a temperature of at least 1,000° C.; by limiting the respective contents of silicon, aluminum and nitrogen as the above-mentioned incidental impurities to:

up to 0.10 wt. % for silicon, up to 0.02 wt. % for aluminum, and up to 0.004 wt. % for nitrogen;

by hot-working the thus heated material at a finishing temperature of at least 1,000° C. to prepare a steel article; and by cooling the thus prepared steel article to a temperature of up to 500° C. at a cooling rate of up to 0.5° C./second; it is possible to cause crystal grains of the steel article to grow to a grain size of at least 50 μm so as to impart a high magnetic permeability and a low coercive force to the steel article.

The present invention was developed on the basis of the above-mentioned findings, and the method for manufacturing a steel article having a high magnetic permeability and a low coercive force comprises the steps of:

using a material consisting essentially of:

carbon: from 0.02 to 0.08 wt. %, manganese: from 0.05 to 0.49 wt. %, and the balance being iron and incidental impurities, where the respective contents of silicon, aluminum and nitrogen as said incidental impurities being:

up to 0.10 wt. % for silicon, up to 0.02 wt. % for aluminum, and up to 0.004 wt. % for nitrogen;

heating said material to a temperature of at least 1,000° C.; then hot-working said material thus heated at a finishing temperature of at least 1,000° C. to prepare a steel article; and then cooling said steel article thus prepared to a temperature of up to 500° C. at a cooling rate of up to 0.5° C./second;

thereby causing crystal grains of said steel article to grow to a grain size of at least 50 μm to impart a high magnetic permeability and a low coercive force to said steel article.

The chemical composition of the steel article of the present invention having excellent magnetic properties including a high magnetic permeability and a low coercive force is limited as described above for the following reasons:

(1) Carbon

Carbon has the function of improving strength of steel. With a carbon content of under 0.02 wt. %, however, pearlite hardly precipitates in the steel, leading to a largely decreased strength of steel, and hence to a lower workability and a lower machinability. With a carbon content of over 0.08 wt. %, on the other hand, pearlite precipitates in an excessively large quantity in the steel, resulting in deteriorated magnetic properties. The carbon content should therefore be limited within the range of from 0.02 to 0.08 wt. %, and more preferably, within the range of from 0.02 to 0.05 wt. %.

(2) Manganese

Manganese has the function of improving strength of steel. with a manganese content of under 0.05 wt. %, however, a desired effect as described above cannot be obtained. With a manganese content of over 0.49 wt. %, on the other hand, strength of the steel becomes excessively high, resulting in a lower workability, and the decreased magnetic flux density leads to deterioration of magnetic properties. The manganese content should therefore be limited within the range of from 0.05 to 0.49 wt. %.

(3) Silicon

Silicon is one of impurities inevitably entrapped into steel. Although the silicon content should preferably be the lowest possible, it is difficult from the economic point of view to largely reduce the silicon content in an industrial scale. With a silicon content of over 0.10 wt. %, however, magnetic flux density in steel decreases, leading to deterioration of magnetic properties. The silicon content should therefore be limited to up to 0.10 wt. %.

(4) Aluminum

Since aluminum has a strong function of deoxidation, aluminum is added to molten steel as a deoxidizing agent when refining steel. As a result, aluminum inevitably remains in the steel article as an impurity. Although the aluminum content should preferably be the lowest possible, it is difficult from the economic point of view to largely reduce the aluminum content in an industrial scale. With an aluminum content of over 0.02 wt. %, however, aluminum nitride (AlN) is precipitated in the steel article during cooling after hot-working. The precipitated aluminum nitride inhibits growth of the crystal grains of the steel article, thus deteriorating magnetic properties. The aluminum content should therefore be limited to up to 0.02 wt. %.

(5) Nitrogen

Nitrogen is one of impurities inevitably entrapped into steel. Although the nitrogen content should preferably be the lowest possible, it is difficult from the economic point of view to largely reduce the nitrogen content in an industrial scale. With a nitrogen content of over 0.004 wt. %, however, nitrides such as aluminum nitride are precipitated in the steel article during cooling after hot-working. The precipitated nitrides inhibit growth of the crystal grains of the steel article, and as a result cause deterioration of magnetic properties. The nitrogen content should therefore be limited to up to 0.004 wt. %.

In the method of the present invention, a material having the above-mentioned chemical composition is heated to a temperature of at least 1,000° C., then the thus heated material is hot-worked at a finishing temperature of at least 1,000° C. to prepare a steel article, and then the thus prepared steel article is cooled to a temperature of up to 500° C. at a cooling rate of up to 0.5° C./second. The heating temperature, the finishing temperature, the cooling rate and the cooling arrest temperature are limited within the above-mentioned respective ranges for the following reasons:

(1) Heating temperature

When the above-mentioned material is heated to a temperature of at least 1,000° C., austenite crystal grains of the material grow to a larger grain size, resulting in improved magnetic properties. In order to further improve magnetic properties, it is desirable to heat the material to a temperature of at least 1,100° C. With a heating temperature of the material of under 1,000° C. aluminum nitride (AlN) precipitated in the material inhibits growth of the austenite crystal grains to a small grain size, thus resulting in deterioration of magnetic properties. The heating temperature should therefore be limited to at least 1,000° C., and more preferably, to at least 1,100° C.

(2) Finishing temperature

When the thus heated material is hot-worked into a steel article at a finishing temperature of at least 1,000° C., the hot-working is accomplished in a high-temperature austenite region, so that strain produced during hot-working does not remain in the resultant steel article, thus giving excellent magnetic properties. With a finishing temperature of under 1,000° C., strain produced during hot-working remains in the steel article, resulting in deterioration of magnetic properties. The finishing temperature should therefore be limited to at least 1,000° C.

(3) Cooling rate and cooling arrest temperature

When the prepared steel article is cooled to a temperature of up to 500° C. at a cooling rate of up to 0.5°/second, austenite crystal grains in the steel article grow, thus resulting in excellent magnetic properties. When the cooling rate is over 0.5° C./second, and/or cooling is arrested at a temperature of over 500° C., the austenite crystal grains in the steel article do not sufficiently grow, thus resulting in deterioration of magnetic properties. Therefore, the cooling rate should be limited to up to 0.5° C./second, and the cooling arrest temperature should be limited to up to 500° C.

In the steel article prepared from the steel having a chemical composition within the scope of the present invention, there is a close relationship between the heat treatment conditions, which include the heating temperature, the finishing temperature, the cooling rate and the cooling arrest temperature, and the crystal grain size. The relationship between these factors and the relationship between the crystal grain size and the magnetic permeability are described below.

Slabs were prepared from steels having a chemical composition within the scope of the present invention. These slab were heated, hot-rolled, and cooled under the conditions as shown in Table 1 to prepare steel sheet samples Nos. 1 to 7.

TABLE 1

| Steel sheet sample No. | Heating temperature (°C.) | Finishing temperature (°C.) | Cooling rate (°C./sec) | Cooling arrest temperature (°C.) |
|---|---|---|---|---|
| 1 | 1270 | 1200 | 0.05 | room temp. |
| 2 | 1250 | 1150 | 0.10 | room temp. |
| 3 | 1250 | 1050 | 0.10 | room temp. |
| 4 | 1250 | 950 | 0.10 | room temp. |
| 5 | 1250 | 1150 | 0.60 | room temp. |
| 6 | 980 | 950 | 0.10 | room temp. |

TABLE 1-continued

| Steel sheet sample No. | Heating temperature (°C.) | Finishing temperature (°C.) | Cooling rate (°C./sec) | Cooling arrest temperature (°C.) |
|---|---|---|---|---|
| 7 | 1250 | 1150 | 0.40 | 650 |

As is clear from Table 1, in the steel sheet samples Nos. 1 to 3, all the heating temperature, the finishing temperature, the cooling rate and the cooling arrest temperature are within the scope of the present invention. In the steel sheet samples Nos.4 to 7, in contrast, any one of the above-mentioned conditions is outside the scope of the present invention. The relationship between the crystal grain size and the maximum magnetic permeability was investigated for the steel sheet samples Nos. 1 to 7. The result is shown in FIG. 1. In FIG. 1, the reference numerals represent the above-mentioned steel sheet sample numbers.

As is clear from FIG. 1, in the steel sheet samples Nos. 1 to 3, in which all the heating temperature, the finishing temperature, the cooling rate and the cooling arrest temperature are within the scope of the present invention, the crystal grain size is as large as at least 60 μm. In contrast, in the steel sheet samples Nos. 4 to 7, in which any one of the above-mentioned conditions is outside the scope of the present invention, the crystal grain size is as small as under 50 μm. Therefore, by heating and hot-working the material having the chemical composition within the scope of the present invention into a steel article under the conditions within the scope of the present invention, and then, by cooling the resultant steel article under the conditions within the scope of the present invention, the crystal grains of the steel article grow to a larger grain size. As is evident from FIG. 1, furthermore, the maximum magnetic permeability increases according as the crystal grain size becomes larger. Particularly, with a crystal grain size of at least 50 μm, the maximum magnetic permeability is so high as at least 4,500.

Now, the method of the present invention for manufacturing a steel article having excellent magnetic properties including a high magnetic permeability and a low coercive force, is described in more detail by means of an example.

EXAMPLE

Steels having the chemical composition within the scope of the present invention as shown in Table 2 (hereinafter referred to as the "steels of the invention") A, B and C, and steels having the chemical composition outside the scope of the present invention as shown in Table 2 (hereinafter referred to as the "steels for comparison") D, E and F were prepared in a converter, then continuously cast into blooms. Then the resultant blooms were hot-rolled into steel bars. Subsequently, these steel bars were heated, hot-forged and cooled under the conditions shown in Table 3 to prepare rotor samples Nos. 1 to 12. For these rotor samples Nos. 1 to 12, there were investigated the maximum magnetic permeability μ max, the magnetic flux density $B_1$ in the magnetic field of 1 Oersted (Oe), the magnetic flux density $B_{25}$ in the magnetic field of 25 Oersted (Oe), and the coercive force Hc. The results are shown also in Table 3.

TABLE 2

| Kind of steel | Chemical composition (wt. %) C | Si | Mn | P | S | Sol. Al | Total N | Remarks |
|---|---|---|---|---|---|---|---|---|
| A | 0.042 | 0.01 | 0.33 | 0.019 | 0.018 | 0.008 | 0.0018 | Steel of the invention |
| B | 0.074 | 0.05 | 0.40 | 0.020 | 0.015 | 0.008 | 0.0015 | Steel of the invention |
| C | 0.025 | 0.01 | 0.28 | 0.016 | 0.022 | 0.010 | 0.0028 | Steel of the invention |
| D | 0.040 | 0.01 | 0.35 | 0.017 | 0.019 | 0.040 | 0.0030 | steel for comparison |
| E | 0.097 | 0.01 | 0.31 | 0.015 | 0.020 | 0.002 | 0.0014 | steel for comparison |
| F | 0.15 | 0.20 | 0.70 | 0.019 | 0.023 | 0.025 | 0.0061 | steel for comparison |

TABLE 3

| Rotor sample No. | Kind of steel | Heating temperature (°C.) | Finishing temperature (°C.) | Cooling rate (°C./sec) | Cooling arrest temperature (°C.) | Crystal grain size (μm) | Maximum magnetic permeability μ max | Magnetic flux density $B_1$ (G) | Magnetic flux density $B_{25}$ (G) | Coercive force Hc (Oe) | Remarks |
|---|---|---|---|---|---|---|---|---|---|---|---|
| 1 | A | 1,270 | 1,200 | 0.05 | room temp. | 120 | 5,600 | 5,000 | 16,500 | 0.9 | Sample of the invention |
| 2 | A | 1,250 | 1,150 | 0.1 | room temp. | 66 | 4,950 | 3,900 | 16,500 | 1.2 | Sample of the invention |
| 3 | A | 1,250 | 1,150 | 0.6 | room temp. | 44 | 3,760 | 1,750 | 16,300 | 1.5 | Sample for comparison |
| 4 | A | 1,250 | 1,050 | 0.1 | room temp. | 64 | 4,860 | 3,850 | 16,400 | 1.2 | Sample of the invention |
| 5 | A | 980 | 950 | 0.1 | room temp. | 21 | 2,330 | 900 | 15,900 | 2.0 | Sample for comparison |
| 6 | A | 1,250 | 950 | 0.1 | room temp. | 49 | 4,325 | 2,500 | 16,400 | 1.3 | Sample for comparison |
| 7 | B | 1,250 | 1,150 | 0.2 | room temp. | 60 | 4,520 | 3,170 | 16,300 | 1.1 | Sample of the invention |
| 8 | C | 1,250 | 1,150 | 0.4 | room temp. | 72 | 5,210 | 4,190 | 16,450 | 1.1 | Sample of the invention |
| 9 | D | 1,270 | 1,200 | 0.05 | room temp. | 48 | 4,430 | 3,000 | 16,100 | 1.1 | Sample for comparison |
| 10 | E | 1,270 | 1,200 | 0.05 | room temp. | 52 | 3,500 | 1,800 | 15,900 | 1.3 | Sample for comparison |
| 11 | F | 1,250 | 1,150 | 0.1 | room temp. | 23 | 1,900 | 700 | 14,500 | 2.3 | Sample for comparison |
| 12 | C | 1,250 | 1,150 | 0.4 | 650 | 45 | 3,920 | 1,790 | 16,300 | 1.6 | Sample for comparison |

As is clear from Table 3, in any of the rotor samples Nos. 1, 2 and 4 manufactured from the steel of the invention A, the steel bar was heated to a temperature of at least 1,250° C. within the scope of the present invention, and then hot-forged into the rotor sample at a finishing temperature of at least 1,050° C. within the scope of the present invention, and the rotor sample was cooled at a cooling rate of up to 0.1° C./second within the scope of the present invention to the room temperature within the scope of the present invention. In any of the rotor samples Nos. 1, 2 and 4 therefore, the crystal grains have a grain size of at least 64 μm, resulting in a high maximum magnetic permeability of at least 4,860 and a low coercive force of up to 1.2 Oersted (Oe).

Also in any of the rotor sample No. 7 manufactured from the steel of the invention B and the rotor sample No. 8 manufactured from the steel of the invention C, the steel bar was heated to a temperature of 1,250° C. within the scope of the present invention, and then hot-forged into the rotor sample at a finishing temperature of 1,150° C. within the scope of the present invention, and the rotor sample was cooled at a cooling rate of up to 0.4° C./second within the scope of the present invention to the room temperature within the scope of the present invention. In any of the rotor samples Nos. 7 and 8, therefore, the crystal grains have a grain size of at least 60 μm, resulting in a high maximum magnetic permeability of at least 4,520 and a low coercive force of 1.1 Oersted (Oe).

Contrary to the above, in the rotor sample No. 3 manufactured from the steel of the invention A, the steel bar was heated to a temperature of 1,250° C. within the scope of the present invention, and then hot-forged into the rotor sample at a finishing temperature of 1,150° C. within the scope of the present invention, but the rotor sample was cooled at a cooling rate of 0.6° C./second outside the scope of the present invention to the room temperature within the scope of the present invention. In the rotor sample No. 3, therefore, the crystal grains have a small grain size of 44 μm, resulting in a low maximum magnetic permeability of 3,760 and a high coercive force of 1.5 Oersted (Oe).

In the rotor sample No. 5 manufactured from the steel of the invention A, the steel bar was heated to a temperature of 980° C. outside the scope of the present invention, and then hot-forged into the rotor sample at a finishing temperature of 950° C. outside the scope of the present invention. Therefore, although the rotor sample was then cooled at a cooling rate of 0.1° C./second within the scope of the present invention to the room temperature within the scope of the present invention, in the rotor sample No. 5, the crystal grains have a small grain size of 21 μm, resulting in a low maximum magnetic permeability of 2,330 and a high coercive force of 2.0 Oersted (Oe).

In the rotor sample No. 6 manufactured from the steel of the invention A, the steel bar was heated to a temperature of 1,250° C. within the scope of the present invention, and then hot-forged into the rotor sample at a finishing temperature of 950° C. outside the scope of the present invention. Therefore, although the rotor sample was then cooled at a cooling rate of 0.1° C./second within the scope of the present invention to the room temperature within the scope of the present invention, in the rotor sample No. 6, the crystal grains have a small grain size of 49 μm, resulting in a low maximum magnetic permeability of 4,325 and a high coercive force of 1.3 Oersted (Oe).

In the rotor sample No. 12 manufactured from the steel of the invention C, although the steel bar was heated to a temperature of 1,250° C., then hot-forged into the rotor sample at a finishing temperature of 1,150° C., and the rotor sample was cooled at a cooling rate of 0.4° C./second, all under the conditions within the scope of the present invention, cooling of the rotor sample was arrested at a temperature of 650° C. outside the scope of the present invention. In the rotor sample No. 12, therefore, the crystal grains have a small grain size of 45 μm, resulting in a low maximum magnetic permeability of 3,920 and a high coercive force of 1.6 Oersted (Oe).

Also in any of the rotor samples Nos. 9 to 11 manufactured respectively from the steels for comparison D, E and F, all having the chemical composition outside the scope of the present invention, although the steel bar was heated to a temperature of at least 1,250° C., then hot-forged into the rotor sample at a finishing temperature of at least 1,150° C. and the rotor sample was cooled at a cooling rate of up to 0.1° C./second to the room temperature, all under the conditions within the scope of the present invention, the rotor sample No. 9 contained aluminum in an amount of 0.04 wt. % outside the scope of the present invention, the rotor sample No. 10 contained carbon in an amount of 0.097 wt. % outside the scope of the present invention, and the rotor sample No. 11 contained carbon, manganese, aluminum, silicon and nitrogen outside the scope of the present invention. In any of the rotor samples Nos. 9 to 11, therefore, the maximum magnetic permeability is as low as up to 4,430, and the coercive force is as high as at least 1.3 Oersted (Oe).

The above-mentioned hot-working in the present invention is not limited to the hot-forging as described in the example, but may be hot-rolling or hot-pressing.

According to the present invention, as described above in detail, it is possible to manufacture at a low cost a steel article having excellent magnetic properties including a high magnetic permeability and a low coercive force, and the thus manufactured steel article can be used as a rotor made of a soft magnetic material for an electric power generator and the like, thus providing industrially useful effects.

What is claimed is:

1. A method manufacturing a steel article having a high magnetic permeability and a low coercive force, comprising the steps of:

providing a steel consisting essentially of:

carbon: from 0.02 to 0.08 wt. % manganese: from 0.05 to 0.49 wt. % and the balance iron and incidental impurities; the contents of silicon, aluminum and nitrogen as said incidental impurities are up to 0.10 wt. % for silicon, up to 0.02 wt. % for aluminum, and up to 0.004 wt. % for nitrogen;

heating said steel to a temperature of at least 1,000° C.; then hot-working said heated steel at a finishing temperature of at least 1,000° C. to form a steel article; and then cooling said steel article to a temperature of up to 500° C. at a cooling rate of up to 0.5° C./second;

thereby causing crystal grains of said steel article to grow to a grain size of at least 50 μm to impart a high magnetic permeability and a low coercive force to said steel article.

2. The method as claimed in claim 1, wherein:

the carbon content of said steel is from 0.02 to 0.05 wt. %.

3. The method as claimed in claim 1, wherein:

said steel is heated to a temperature of at least 1,100° C.

4. The method as claimed in claim 2, wherein:

said steel is heated to a temperature of at least 1,100° C.

* * * * *